US008988004B2

(12) United States Patent
Horsky et al.

(10) Patent No.: US 8,988,004 B2
(45) Date of Patent: Mar. 24, 2015

(54) METHOD OF FORMING A CURRENT CONTROLLER FOR AN LED AND STRUCTURE THEREFOR

(71) Applicants: Pavel Horsky, Brno (CZ); Jean-Paul Eggermont, Pellaines (BE)

(72) Inventors: Pavel Horsky, Brno (CZ); Jean-Paul Eggermont, Pellaines (BE)

(73) Assignee: Semiconductor Components Industries, LLC, Phoenix, AZ (US)

( * ) Notice: Subject to any disclaimer, the term of this patent is extended or adjusted under 35 U.S.C. 154(b) by 330 days.

(21) Appl. No.: 13/744,691

(22) Filed: Jan. 18, 2013

(65) Prior Publication Data

US 2014/0203720 A1 Jul. 24, 2014

(51) Int. Cl.
*G05F 1/00* (2006.01)
*H05B 33/08* (2006.01)

(52) U.S. Cl.
CPC ..... *H05B 33/0827* (2013.01); *Y10T 29/49117* (2015.01)
USPC ..... 315/294

(58) Field of Classification Search
CPC ..... H05B 33/0812; H05B 33/0824; H05B 33/0836
USPC ..... 315/291, 294, 295, 297, 299, 301; 327/403, 404
See application file for complete search history.

(56) References Cited

U.S. PATENT DOCUMENTS

| | | | | |
|---|---|---|---|---|
| 6,864,641 | B2 * | 3/2005 | Dygert | 315/216 |
| 7,119,498 | B2 | 10/2006 | Baldwin et al. | |
| 7,122,971 | B2 | 10/2006 | Yeh et al. | |
| 7,675,487 | B2 | 3/2010 | De Oto | |
| 7,705,547 | B2 | 4/2010 | Schindel et al. | |
| 7,733,034 | B2 | 6/2010 | Kotikalapoodi et al. | |
| 8,018,170 | B2 * | 9/2011 | Chen et al. | 315/192 |
| 8,872,445 | B2 * | 10/2014 | Egawa et al. | 315/307 |
| 8,907,584 | B2 * | 12/2014 | Lim et al. | 315/247 |

* cited by examiner

*Primary Examiner* — Jeffrey Zweizig
(74) *Attorney, Agent, or Firm* — Robert F. Hightower

(57) ABSTRACT

In one embodiment, an LED current controller is formed to determine which of a plurality of LED branches has the largest voltage drop and to select the current through that branch to use in controlling the value of current that flows through other LED branches.

20 Claims, 4 Drawing Sheets

10

200

Ref2
Ref2
CS

METHOD OF FORMING A CURRENT CONTROLLER FOR AN LED AND STRUCTURE THEREFOR

BACKGROUND OF THE INVENTION

The present invention relates, in general, to electronics, and more particularly, to semiconductors, structures thereof, and methods of forming semiconductor devices.

In the past, the electronics industry developed various circuits and methods for controlling the current in light emitting diodes (LEDS) and particularly in LEDs that were connected in parallel circuits. The different parallel circuits could often have different voltage drops or different current values which often lead to inefficient operation. Some of the circuits used a transistor and a resistor in the current flow path to control the value of the current through the LEDs. However, those transistor and resistor combinations often dissipated significant power and also resulted in inefficient operation.

Accordingly, it is desirable to have a circuit and method for controlling current through a light source that results in more efficient operation, and less power dissipation in the current control elements.

Figure 1:
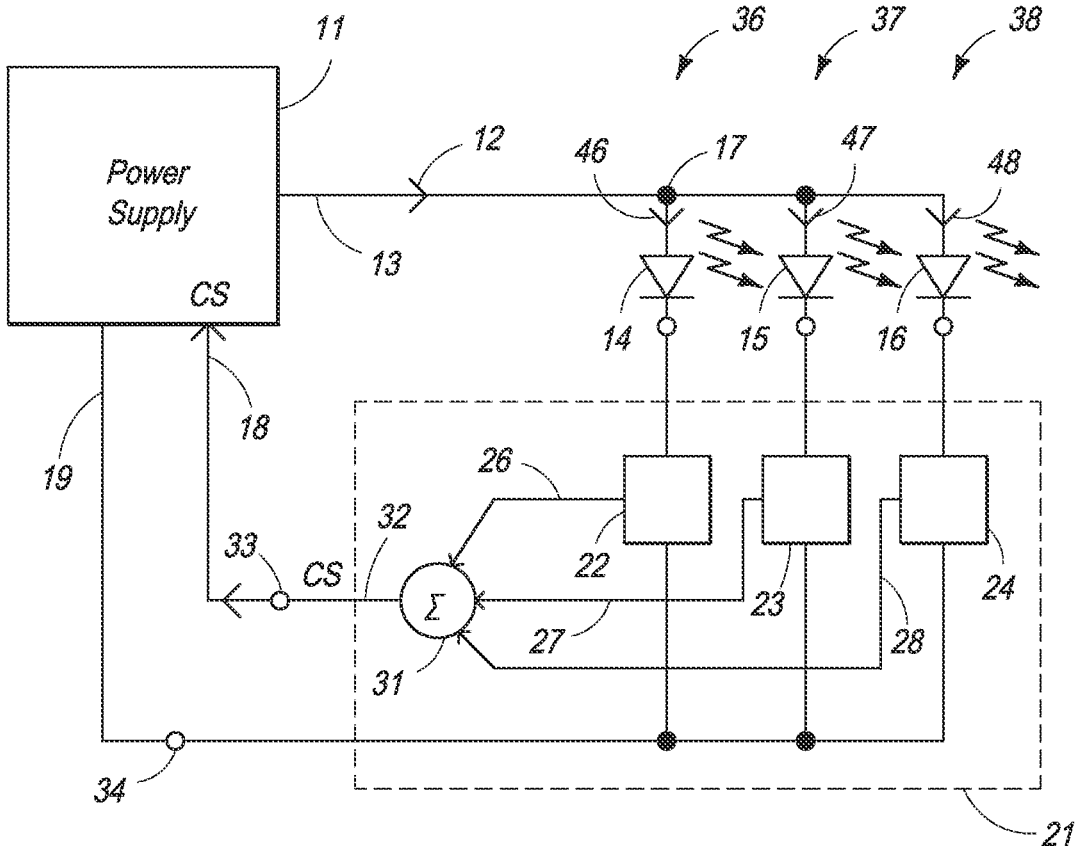
FIG. 1 schematically illustrates an example of an embodiment of a portion of an LED control system that includes an LED current controller in accordance with the present invention.

For simplicity and clarity of the illustration (s) elements in the figures are not necessarily to scale, and the same reference numbers in different figures denote the same elements, unless stated otherwise. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current through the device such as a gate of an MOS transistor or a base of a bipolar transistor. Although the devices are explained herein as certain N-channel or P-Channel devices, or certain N-type or P-type doped regions, a person of ordinary skill in the art will appreciate that complementary devices are also possible in accordance with the present invention. One of ordinary skill in the art understands that the conductivity type refers to the mechanism through which conduction occurs such as through conduction of holes or electrons, therefore, and that conductivity type does not refer to the doping concentration but the doping type, such as P-type of N-type. It will be appreciated by those skilled in the art that the words during, while, and when as used herein relating to circuit operation are not exact terms that mean an action takes place instantly upon an initiating action but that there may be some small but reasonable delay(s), such as various propagation delays, between the reaction that is initiated by the initial action. Additionally, the term while means that a certain action occurs at least within some portion of a duration of the initiating action. The use of the word approximately or substantially means that, unless otherwise explained hereinafter, a value of an element has a parameter that is expected to be close to a stated value or position. However, as is well known in the art there are always minor variances that prevent the values or positions from being exactly as stated. It is well established in the art that variances of up to at least ten percent (10%) (and up to twenty percent (20%) for semiconductor doping concentrations) are reasonable variances from the ideal goal of exactly as described. When used in reference to a state of a signal, the term "asserted" means an active state of the signal and the term "negated" means an inactive state of the signal. The actual voltage value or logic state such as a "1" or a "0") of the signal depends on whether positive or negative logic is used. Thus, asserted can be either a high voltage or a high logic or a low voltage or low logic depending on whether positive or negative logic is used and negated may be either a low voltage or low state or a high voltage or high logic depending on whether positive or negative logic is used. Herein, a positive logic convention is used, but those skilled in the art understand that a negative logic convention could also be used. The terms first, second, third and the like in the claims or/and in the Detailed Description of the Drawings, as used in a portion of a name of an element are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein.

DETAILED DESCRIPTION OF THE DRAWINGS

FIG. 1 schematically illustrates an example of an embodiment of a portion of an LED control system 10 that includes a plurality of LED branches, for example LED branches 36-38, that are connected in parallel or pseudo-parallel with each other branch because they have at least one common connection at a node 17 and the current through the branches returns to another node such as the one connected to a common return terminal or common return 34. Although only one LED is shown in each of LED branches 36-38, those skilled in the art will appreciate that more LEDs may be connected in series within each branch. For example, LED branch 36 may include other LEDs connected in series with LED 14 or LED branch 37 may include other LEDs connected in series with LED 15. System 10 usually includes a power supply 11 that provides power to operate the LEDs in branches 36-38. Power supply 11 has an output 13 that provides a load current 12 in order to supply LED currents 46-48 to respective LED branches 36-38.

A current controller 21 of system 10 is formed to control the value of LED currents 46-48 that flow through each of branches 36-38, respectively. In one embodiment, the value of currents 46-48 is controlled to be substantially equal. In other embodiments, the value of currents 46-48 may be ratioed to each other. For example, the value of current 47 (or current 48) may be controlled as a ratio of current 46 so that current 47 may be some amount larger or smaller than current 46 but still a ratio of current 46. For example the branches may need different currents to match intensity for branches that have different color LEDs, or for other reasons. Those skilled in the art will also appreciate that the ratios may be formed between other members of currents 46-48, for example currents 46 and 48 may be ratioed to current 47, or currents 46-47 may be ratioed to current 48, etc. For the purpose of clarity of the explanation, the explanations herein will use the term "substantially equal", however, those skilled in the art will appreciate that the currents may be ratioed to each other using various ratio values than 1:1. Controller 21 includes a plurality of current control cells illustrated in FIG. 1 as three current control cells 22-24. Typically, controller 21 includes one current control cell for each LED branch. In most embodiments, each of current control cells 22-24 includes a respective current sense output 26-28 that each forms a cell current sense signal. Each cell current sense signal is representative of the respective current 46-48 that flows though the corresponding one of branches 36-38 and is ratioed to the value of the corresponding LED current. A summing circuit 31 sums the value of the cell current sense signals provided on outputs 26-28 and forms a current sense (CS) signal on a current sense output 33 of controller 21. Those skilled in the art will appreciate that the value of the current sense (CS) signal may be formed in other ways such as an average value of the cell current sense signals. Power supply 11 receives the current sense (CS) signal and regulates the value of load current 12 supplied to LED branches 36-38. Those skilled in the art will appreciate that supply 11 may be a buck or boost PWM converter that operates in a current loop regulation mode or in both voltage and current regulation mode, or may be some other type of power supply, such as a linear voltage regulator, that includes a current regulation mode.

Those skilled in the art will appreciate that other arrangements between cells 22-24 and LEDs 14-16 may also be applicable. For example, with appropriate changes in polarities such as within cells 22-24, the position of cells 22-24 may be placed between node 17 and LEDs 14-16 instead of in the position shown in FIG. 1. For such an arrangement, branches 36-38 would still be formed in a parallel or pseudo-parallel configuration with a common connection at a node, such as at the node connected to return 34.

Figure 2:
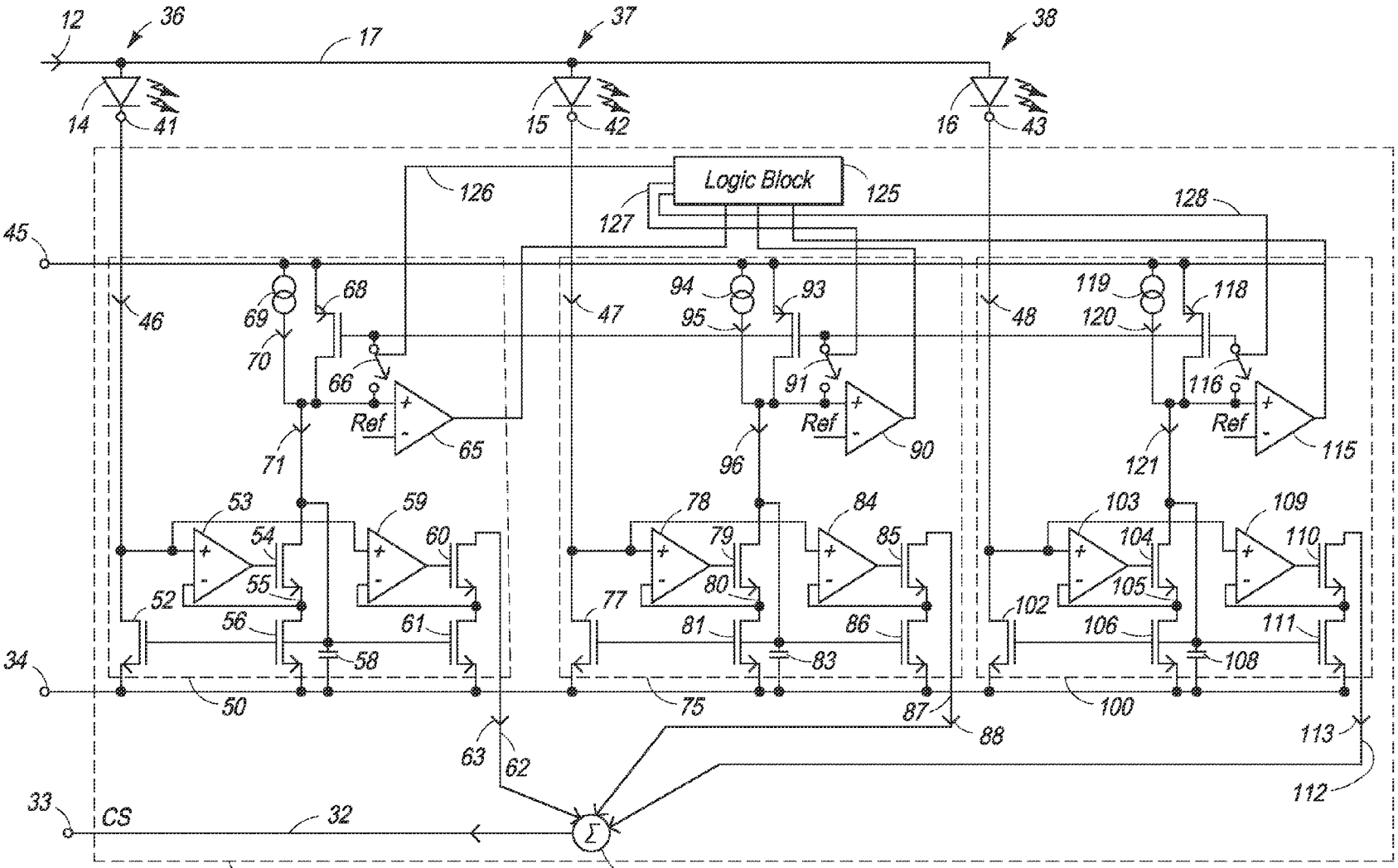
FIG. 2 schematically illustrates an example of an embodiment of a portion of an LED current controller that is an alternate embodiment of the LED current controller of FIG. 1 in accordance with the present invention.

FIG. 2 schematically illustrates a portion of an example embodiment of an LED current controller 40 that is an alternate embodiment of controller 21 explained in the description of FIG. 1. Controller 40 includes a plurality of LED current inputs 41-43 that are configured to receive the respective LED currents 46-48 from respective branches 36-38.

Controller 40 may, in some embodiments, receive bower for operating the elements of controller 40 between a voltage input 45 and a common return 34. Controller 40 may receive power from a power supply such as supply 11 (FIG. 1) or may include an internal regulator that receives power, such as from supply 11 or another source, and regulates it to a value for operating controller 40. Controller 40 includes a plurality of current control cells 50, 75, and 100 that are configured to conduct one of LED currents 46-48, respectively, from each of respective branches 36-38. Cells 50, 75, and 100 are alternate embodiments of cells 22-24 described in the description of FIG. 1. Those skilled in the art will appreciate that cells 50, 75, and 100 may be positioned differently relative to the position of respective LEDs 14-16 within the respective branches 36-38 as explained in the description of FIG. 1. Controller 40 also includes a common cell or logic block, or logic 125 that assists in selecting one of cells 50, 75, or 100 as a control cell. In the preferred embodiment, only one of cells 50, 75, or 100 is selected as a control cell at any particular time. Other embodiments may use other selection criteria. Although logic 125 is illustrated as a separate block of controller 40, logic 125 could also be formed as a portion of anyone of cells 50, 75, or 100. Logic 125 may include control signals 126-128 that assist in selecting the control cell.

Cell 50 is configured to include an amplifier 53, transistor 54, and an image transistor 56 that form a feedback loop to assist in forming current ratios. Amplifier 59 and transistors 60 and 61 assist in forming a cell current sense signal 62 that is representative of the value of LED current 46. Cell 50 also includes a current source 69, a mirror transistor 68, a switch 66 (such as a switch transistor), and a comparator 65. Cell 75 includes similar elements including an amplifier 78, a transistor 79, and an image transistor 81 that form a feedback loop to assist in forming current ratios. An amplifier 84 and transistors 85 and 86 assist in forming a cell current sense signal 87 that is representative of the value of LED current 47. Cell 75 also includes a current source 94, a mirror transistor 93, a switch 91 (such as a switch transistor), and a comparator 90. Similarly, cell 100 includes an amplifier 103, a transistor 104, and an image transistor 106 that form a feedback loop to assist in forming current ratios. An amplifier 109 and transistors 110 and ill assist in forming a cell current sense signal 112 that is representative of the value of LED current. Cell 100 also includes a current source 119 a mirror transistor 118, a switch 116 (such as a switch transistor), and a comparator 115. Cells 50, 75, and 115 may also include optional capacitors 58, 83 and 108 that may be used for frequency compensation to assist in providing stability for the feedback loops.

In operation, cells 50, 75, and 100 are configured to determine which of branches 36-38 has a highest voltage drop across the LED branch, such as drops the largest total voltage across the LEDs in the branch, and to select one of current control cells 50, 75, 100 as a control cell configured to receive the respective current 46-48 from the selected cell, to form a control current that is representative of the selected LED current, and to cause the other cells to regulate the value of the other LED currents to be ratioed (such as a ratio of 1:1) to the LED current of the control cell. The ratio may cause the controlled LED current(s) to be greater than, substantially equal to, or less than the value of the LED current of the selected control cell. In the preferred embodiment, the controlled LED currents are substantially equal to the selected LED current.

Cells 50, 75, and 100 may include respective optional current sources 69, 94, and 119 that form respective currents 70, 95, and 120. In one embodiment, the value of currents 70, 95, and 120 are substantially equal, but may be other values in other embodiments. The current from these optional current sources are used as a start-up current to assist the respective cells with an initial current to cause the cells to begin operating. Sources 69, 94 and 119 are optional and may be omitted in some embodiments. The values of each of currents 70, 95, and 120 typically are much much less than the normal operating value of currents 71, 96, and 121 that flow when the cells are conducting an LED current. In one embodiment, the value of currents 70, 95, and 120 were approximately two orders of magnitude less than the value of currents 71, 96, and 121.

As cells 50, 75, and 100 receive the respective LED currents 46-48, the LEDs of one of branches 36-38 will have a larger voltage drop than the LEDs of other of branches 36-38. Assume, for operational discussion, that LED 15 of branch 37 has a larger voltage drop across LED 15 than branches 36 and 38 have across respective LEDs 14 and 16. As a result, the drain voltage of control transistor 77 will be lower than the drain voltage of control transistors 52 and 102. Also, the gate voltage (or gate-to-source [Vgs]) of transistor 77 will be greater than the gate voltage (Vgs) of transistors 52 and 102.

Therefore, transistor 77 is fully turned ON and has the lowest on resistance of transistors 52, 77, and 102. Fully turning-ON transistor 77 reduces the power dissipation of controller 40.

For purposes of this example operational explanation, assume that logic 125 selects cell 75 as the control cell to form the control current and asserts corresponding control signal 127. Asserting signal 127 closes switch 91 (such as enables a transistor) which forms transistor 93 as a reference transistor in a current mirror configuration with transistors 68 and 118. The diode configuration of transistor 93 causes the value of the gate voltage (Vgs) of transistor 77 to be much greater than the gate voltage of transistors that are not selected as the control transistors and causes transistor 77 to be fully turned ON. In the preferred embodiment, transistor 93 is formed such that selectively configuring transistor 93 in a diode configuration as the reference transistor of the current mirror causes the gate voltage of transistor 77 to be close to the value of the input voltage on input 45 thereby causing transistor 77 to be fully enabled and fully turned ON. The input current to this current mirror is current 96 minus current 95 from optional current source 94. In the preferred embodiment, the value of currents 70, 95, and 120 is very small compared to the value of respective currents 71, 96, and 121, thus, the value of currents 70, 95, and 120 have substantially no effect on the normal operation of controller 40. Consequently, the value of the currents through transistors 68, 93, and 118 is substantially the value of currents 71, 96, and 121, respectively. The current mirror configuration of transistors 68 and 118 with transistor 93 forms respective currents 71 and 121 to be ratioed to the value of current 96 by the size ratio between transistors 68, 93, and 118.

Amplifier 78 and transistor 79 control the drain voltage of transistor 81 to match the drain voltage of transistor 77. Because transistors 81 and 77 have the same drain and gate voltages, current 96 through transistor 81 is ratioed to the value of current 47 by the size ratio between transistors 77 and 81 and current 96 is representative of LED current 47. Because cell 75 is selected as the control cell, switch 91 is closed and current 96 is selected as the control current.

Amplifier 84 and transistor 85 form a current 88 through transistor 86 that is also ratioed to current 47 by the size ratio between transistors 77 and 86. This forms cell current sense signal 88 to be representative of the value of current 47.

Turning to cell 50 and because cell 50 is not selected as the control cell, logic 125 causes switch 66 to be open, therefore, the current mirror configuration of transistor 68 with transistor 93 causes current 71 to be ratioed to current 96 by the size ratio of transistor 68 to 93, thus, representative of the value of current 47. In the preferred embodiment the ratio is 1:1, but may be other values in other embodiments, so that current 71 is substantially equal to current 96. This forces the current through transistor 56 to be the same as current 71 or ratioed to current 96. The gate voltage of transistors 52 and 56 is controlled by the feedback loop of amplifier 53 and transistor 54. In the preferred embodiment, the feedback loop forms the drain voltage of transistors 52 and 56 to be substantially equal. Thus, transistor 52 conducts a current that is ratioed to the value of current 71, thus ratioed to the value of current 47. The ratio is controlled by the size ratios of transistors 52, 56, 68, 93, 81, and 77. In the preferred embodiment, the value of current 46 is formed to be substantially equal to current 47. Because the voltage drop across LED 14 of branch 36 is less than the voltage drop across LED 15 of branch 37, the drain of transistor 52 is at a higher voltage than the drain of transistor 77. Therefore the voltage drop across transistor 52 is greater than the voltage drop across transistor 77 and the gate voltage (Vgs) of transistor 52 is lower or less than the gate voltage (Vgs) of transistor 77. This causes the internal resistance of transistor 52 to be higher than that for transistor 77 and causes transistor 52 to be not fully enabled or not fully switched ON.

Current control cell 100 operates similarly to cell 50 because the voltage drop across LED 16 of branch 38 is also less than the voltage drop across LED 15 of branch 37. Thus, cell 100 regulates the value of current 48 to be ratioed to, for example substantially equal to, the value of current 47 in a manner similar to that of cell 50.

Logic 125 is configured so that controller 40 only selects one of cells 50, 75, or 100 as the control cell. In the preferred embodiment, only one of switches 66, 91, or 116 is enabled or closed thus only one of transistors 68, 93, or 118 is selectively configured as the reference transistor of the current mirror formed with the other ones of transistors 68, 93, and 118. The cell where the switch 66, 91, or 116 is switched ON forces the gate voltage of the corresponding control transistor to have a gate voltage that is greater than the gate voltage of the corresponding transistors of the other cells. In the preferred embodiment, the selected reference transistor causes the gate voltage of the correspondingly selected control transistor to be close to the input voltage on input 45. Therefore, only one of transistors 52, 77, and 102 is selectively configured as the control transistor that is fully enabled and operating in the linear portion of the transistor's characteristics curves at one time and the others are operating with lower gate voltages (or smaller Vgs), thus, they are not fully switched ON and have higher ON-resistances. Comparators 65, 90, and 115 receive the drain voltage of respective transistors 68, 93, and 118. For the one of cells 50, 75, or 100 that receives the lowest voltage on respective inputs 41, 42, or 43, the respective one of transistors 68, 93, and 118 is configured as the reference transistor of the current mirror and has the smallest voltage drop, thus, the highest drain voltage. Comparators 65, 90, and 118 receive the drain voltages of respective transistors 68, 93, and 118 and assert the respective output of the comparator. Logic 125 receives the outputs of comparators 65, 90, and 118 and selects one of cells 50, 75, and 100 as the control cell and closes the one of respective switches 66, 91, and 116.

The value of the reference voltage (Ref) received by comparators 65, 90, and 115 generally is set to a value that is less than the voltage of input 45 by approximately the saturation voltage of corresponding one of transistors 68, 93, and 118, but may be other values in other embodiments. In the preferred embodiment, the same reference value (Ref) is also used for comparators 65 and 115 because the threshold voltage of transistors 68 and 118 is substantially the same as that of transistor 93. In other embodiments, the reference voltage for comparators 65 and/or 115, respectively, may be set to be less than the value on input 45 minus the threshold value of the corresponding one of transistor 68 or 118, respectively. For the example operation described with cell 75 selected as the control cell, the non-inverting input of comparator 90 receives a higher voltage than the corresponding inputs of comparators 65 and 115. Therefore, the output of comparator 90 is asserted and the outputs of comparators 65 and 115 are negated.

Figure 4:
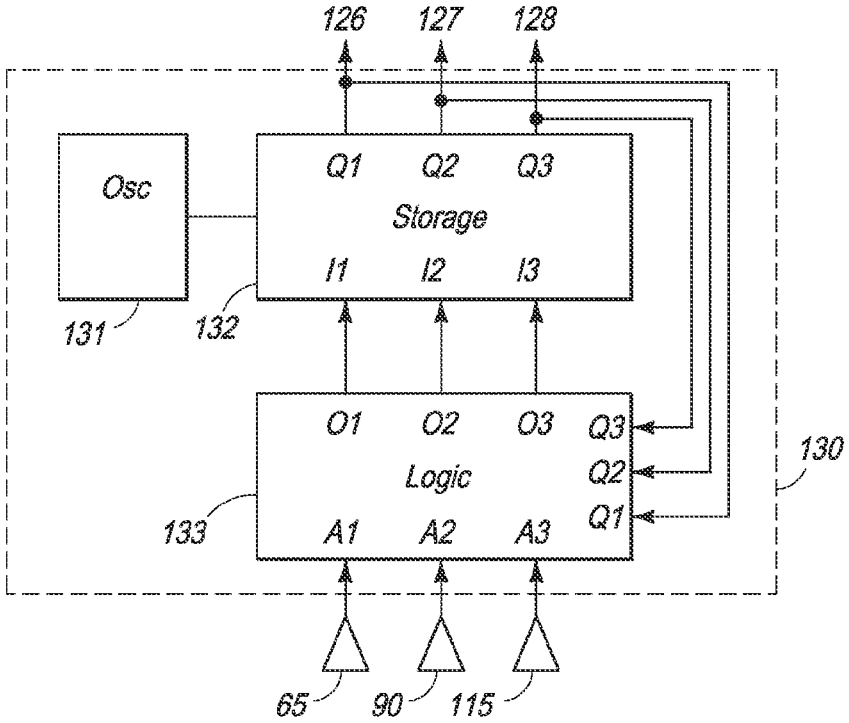
FIG. 4 schematically illustrates a portion of an example embodiment, of a logic block in accordance with the present invention.

FIG. 4 schematically illustrates a portion of an example embodiment of a logic block or logic 130 that is one example embodiment of logic 125. Logic 130 includes an oscillator or Osc 131, a storage element or storage 132 such as a plurality of D type flip-flops or latches, etc., and a combinatory logic element or element 133. Element 133 receives the outputs of comparators 65, 90, and 115, on inputs A1-A3. Element 133 also receives outputs of the storage element 132 on inputs Q1, Q2, and Q3. In the preferred embodiment, only one of element 133 outputs O1, O2, or O3 will be asserted depending on the state of all the inputs to element 133. In one example embodiment of logical functions implemented in the combinatory logic of element 133, the state of outputs O1-O3 may be formed as:

$$O1=(Q1\cdot neg(A2)\cdot neg(A3))+(neg(Q1)\cdot A1\cdot(Q2+neg(A2))\cdot(Q3+neg(A3))),$$

$$O2=(Q2\cdot neg(A1)\cdot neg(A3))+neg(Q2)\cdot A2\cdot(Q3+neg(A3))),$$

and $$O3=(Q3\cdot neg(A1)\cdot neg(A2))+(neg(Q3)\cdot A3).$$

Where:

neg(X) denotes a logical inversion of X; and

QX denotes the logical state of one of the signals Q1-Q3.

Those skilled in the art will appreciate that other logic functions could be used instead of the logic illustrated in the above equations. For example element 133 may be of the type that determines priority based on the input position such as inputs A1, A2, or A3) in order to select only one of the asserted inputs. In other embodiments, other prioritization may be used. Those skilled in the art will appreciate that in some embodiments oscillator 131 and storage 132 may be omitted.

Storage 132 stores the state of element 133 outputs O1-O3 at a periodic time interval. Oscillator 131 provides a clock signal to clock storage 132 at the periodic time interval.

For the hereinbefore described example operation with cell 75 selected as the control cell, the signals O2 and Q2 are asserted. The voltage drop across branches 36 and 38 is smaller than the voltage drop across branch 37 and the outputs of comparators 65 and 115 are negated, thus, inputs A1 and A3 of element 133 are negated.

In case that the selected control cell is not the one corresponding to the branch with the highest voltage drop, the output of the comparators of the cell with higher voltage drop will be asserted. Logic 125 is configured to re-select the cell, corresponding to the highest voltage drop as the control cell. For example if cell 75 is selected as control cell, but voltage drop in branch 36 is higher than voltage drop in branch 37, the output of comparator 65 will be asserted. Element 133 will assert signal O1 and negate signal O2. With the next clock pulse generated by oscillator 131, storage 132 will change the state of the outputs, it will assert Q1 and negate Q2. This will cause cell 50 to be selected as control cell.

In the case that more than one comparator, except of the control cell, will be asserted, because there will be multiple cells with higher voltage drop than the control cell, logic 125 will select one cell as the control cell. For example, the logic of element 133 may be used to provide such re-selection.

In one embodiment, logic 125 may be configured to, upon start-up of controller 40, assert one of control signals 126-128 thereby causing the corresponding one of switches 66, 91 and 116 to be enabled and the corresponding cell selected as the control cell. Logic 125 may be configured to always select the same cell at start-up or to randomly select one of the cells. After start-up, logic 125 will determine which cell has the highest voltage drop and then re-select one of the cells as the control cell.

In some embodiments, it may also be desirable to configure logic 125 or 130 to change the cell selected as the control cell responsively to the branch with the largest voltage drop changing, for example if branch 36 becomes the highest voltage drop branch after branch 37 was previously selected as the highest voltage drop branch.

In another embodiment, logic 125 may also be configured to periodically, such as at some predetermined time interval, re-determine which of comparators 65, 90, and 115 has an asserted output and if any of the outputs have changed state to re-select the appropriate one of cells 50, 75, 100 as the control cell.

Therefore, controller 40 is also configured to re-select as the control cell, one of cells 50, 75, or 100 that corresponds to the branch having the highest voltage drop even if the incorrect cell is originally selected, or if the operating conditions change.

As an operation example for explanation of re-selection, assume that in the previous example explanation of cell 75, branch 37 was incorrectly determined to have the highest voltage drop and cell 75 was incorrectly selected, as the control cell. The current mirror configuration between transistors 68 and 93 causes cell 50 to form current 71 to be substantially equal to current 96, thus, representative of the value of LED current 47. Because the voltage drop across branch 36 is greater than the voltage drop across previously selected branch 37, the voltage on the gate of transistor 52 (and also 56) is higher than the voltage on the gate of transistor 77. The gate voltage of transistor 52 can eventually cause the transistor 68 to be to operate in the linear portion of the characteristic curves of the transistor. This may decrease the value of currents 46 and 71. The higher gate voltage of transistor 52 causes the voltage on the positive input of comparator 65 to rise above the reference voltage (Ref) thereby asserting the output of comparator 65 to indicate to logic 125 that the wrong branch was selected as the branch with the highest voltage drop. Logic 125 negates signal 127 and asserts signal 126 causing controller 40 to select cell 50 as the control cell that forms the control current. Thus, controller 40 has re-selected cell 50 as the control cell even though cell 75 was incorrectly selected as the control cell originally. Accordingly, controller 40 is configured to determine a branch having the largest voltage drop and to select the corresponding cell as the control cell.

In order to facilitate the hereinbefore described functionality for controller 40, input 41 is configured to receive LED current 46 and the voltage drop across branch 36. Input 41 is commonly connected to a drain of transistor 52 and the non-inverting inputs of amplifiers 53 and 59. A source of transistor 52 is connected to a source of transistors 56 and 61, to a common voltage return, and to return 34. A gate of transistor 52 is commonly connected to a drain of transistor 54, and a gate of transistors 56 and 61. A drain of transistor 56 is commonly connected to an inverting input of amplifier 53, a node 55, and a source of transistor 54. A gate of transistor 54 is connected to an output of amplifier 53. The drain of transistor 54 is commonly connected to a first terminal of capacitor 58, a first terminal of source 69, a drain of transistor 68, a first terminal, of switch 66, and a non-inverting input of comparator 65. A second terminal of capacitor 58 is connected to return 34. An inverting input of comparator 65 is connected to receive the reference voltage (Ref). An output of comparator 65 is connected to a first input of logic 125. A source of transistor 68 is connected to input 45 and to a second terminal of source 69. A gate of transistor 68 is commonly connected to a gate of transistors 93 and 118 and to a second terminal of switch 66. A control input of switch 66 is connected to an output of logic 125 at signal 126. An output of amplifier 59 is connected to a gate of transistor 60. A source of transistor 60 is commonly connected to a drain of transistor 61 and to the inverting input of amplifier 59. A drain of transistor 60 is connected to output 62 and to a first input of circuit 31.

Input 42 is configured to receive LED current 47 and the voltage drop across branch 37. Input 42 is commonly connected to the drain of transistor 77 and to the non-inverting inputs of amplifiers 78 and 84. A source of transistor 77 is commonly connected to return 34 and to the source of transistors 81 and 86. A gate of transistor 77 is commonly connected to a drain of transistor 79, and the gates of transistors 81 and 86. A drain of transistor 81 is commonly connected to a node 80, a source of transistor 79, and the inverting input of amplifier 78. An output of amplifier 78 is connected to a gate of transistor 79. The drain of transistor 79 is commonly connected to a first terminal of capacitor 83, a first terminal of source 94, a first terminal of switch 91, the non-inverting input of comparator 90, and the drain of transistor 93. A second terminal of capacitor 83 is connected to return 34. A source of transistor 93 is commonly connected to input 45 and a second terminal of source 94. A second terminal of switch 91 is connected to the gate of transistor 93 and a control input of switch 91 is connected to an output of logic 125 at signal 127. The inverting input of comparator 90 is connected to Ref. The output of comparator 90 is connected to a second input of logic 125. An output of amplifier 84 is connected to a gate of transistor 85. A source of transistor 85 is commonly connected to a drain of transistor 86 and to the inverting input of amplifier 84. A drain of transistor 85 is connected to output 87 and to a second input of circuit 31.

Input 43 is configured to receive LED current 48 and the voltage drop across branch 38. Input 43 is commonly connected to a drain of transistor 102 and the non-inverting inputs of amplifiers 103 and 109. A source of transistor 102 is commonly connected to return 34 and to the source of transistors 106 and 111. The gate of transistor 102 is commonly connected to a drain of transistor 104, and a gate of transistors 106 and 111. A drain of transistor 106 is commonly connected to a source of transistor 104, node 105, and an inverting input of amplifier 103. An output of amplifier 103 is connected to a gate of transistor 104. The drain of transistor 104 is commonly connected to a first terminal of capacitor 108, a first terminal of source 119, a drain of transistor 118, a first terminal of switch 116, and a non-inverting input of comparator 115. A second terminal of capacitor 108 is connected to return 34. An inverting input of comparator 115 is connected to Ref. An output of comparator 115 is connected to a third input of logic 125. Output of logic 125 at signal 128 is connected to a control input of switch 116. A second terminal of switch 116 is connected to the gate of transistor 118. A source of transistor 118 is commonly connected to input 45 and a second terminal of source 119. An output of amplifier 109 is connected to a gate of transistor 110. A source of transistor 110 is commonly connected to a drain of transistor 111 and to an inverting input of amplifier 109. A drain of transistor 110 is connected to output 112. Output 112 is connected to a third input of circuit 31. Output 32 of circuit 31 is connected to output 33.

Figure 3:
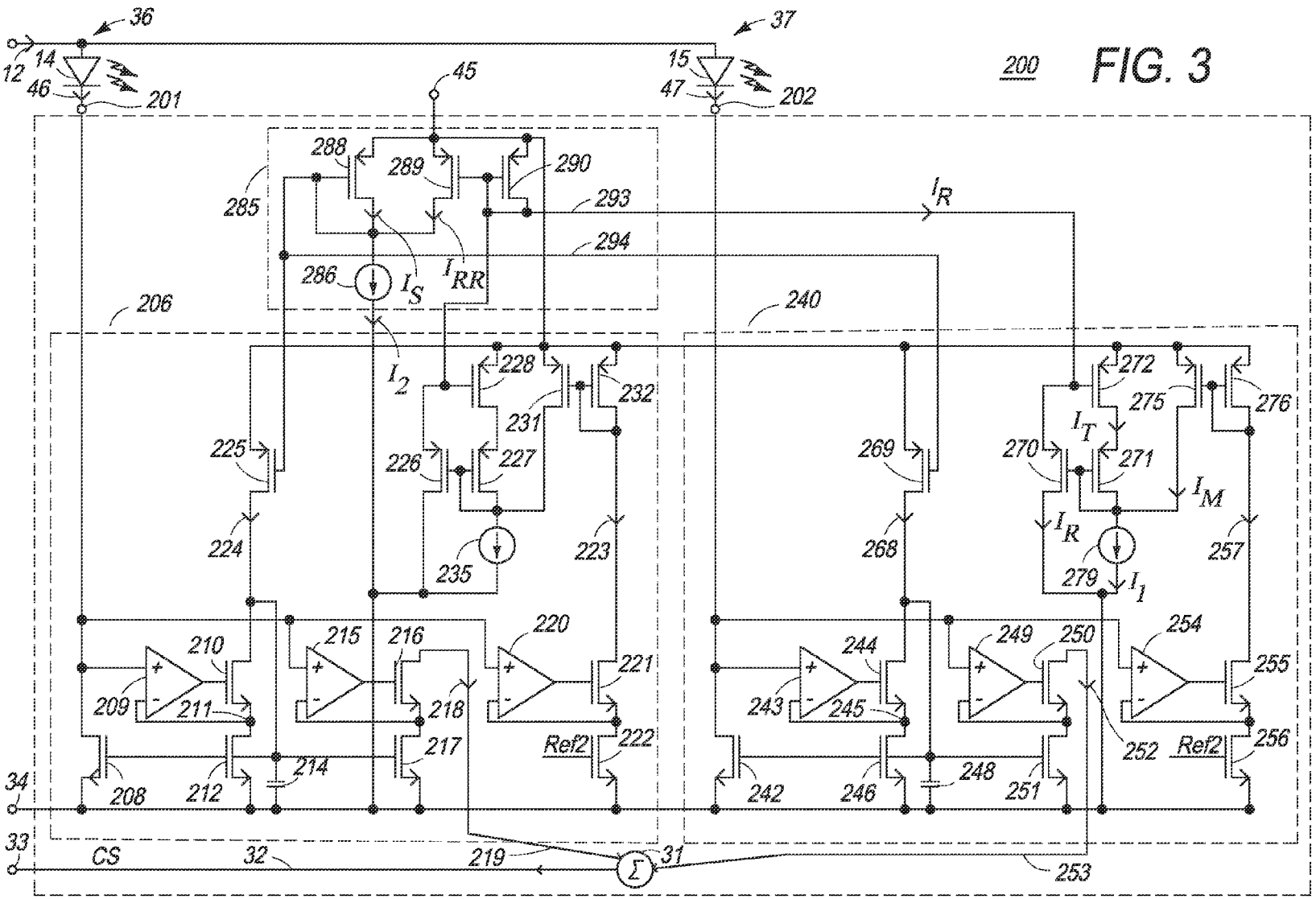
FIG. 3 schematically illustrates an example of an embodiment of a portion of another LED current controller that is an alternate embodiment of the LED current controller of FIGS. 1 and 2 in accordance with the present invention.

FIG. 3 schematically illustrates an example of an embodiment of a portion of an LED current controller 200 that is an alternate embodiment of controllers 21 and 40 that were explained in the description of FIGS. 1 and 2. Controller 200 includes a plurality of current control cells 206 and 240 that are each configured to conduct one of LED currents 46 and 47 respectively. Those skilled in the art will appreciate that although two LED branches and two current control cells are illustrated in FIG. 3, controller 200 may have any number of current control cells that each conducts an LED current from an LED branch. Cells 206 and 240 are configured to select which of cells 206 and 240 receive current from the branch having the largest voltage drop, thus, receives the lowest voltage on the respective input to that cell, and to then form the other LED current to be ratioed to, including substantially equal to, the current of the branch having the largest voltage drop. Forming the LED currents to be substantially equal or ratioed to each other can assists in the LEDs having uniform brightness.

Cell 206 includes transistors 208, 212, 210, 217, and 216 along with amplifiers 209 and 215 that function similarly to respective transistors 52, 56, 54, 61, and 60 and amplifiers 53 and 59. Cell 206 also includes an amplifier 220 and associated transistors 221 and 222 that assist in forming a current that is representative of a maximum possible current for branch 36. Transistors 232, 231, 227, 228, and 226 along with current source 235 assist in selecting the cell of the branch that has the highest voltage drop as the control cell. A transistor 225 assists in controlling the value of the current 46. Cell 240 functions similarly to cell 206 and includes corresponding transistors 242, 246, 244, 251, and 250 along with amplifiers 243 and 249. Cell 240 also includes an amplifier 254 and associated transistors 255 and 256 that function similarly to the corresponding elements of cell 206. Cell 240 further includes transistors 276, 275, 271, 272, and 270 along with current source 279 that function similarly to the corresponding elements of cell 206. A transistor 269 functions similarly to transistor 225 of cell 206.

Controller 200 also includes a common cell 285 that assists cells 206 and 240 in determining which of cells 206 and 240 receives the lowest voltage from respective inputs 201 and 202. Common cell 285 includes transistors 288-290 along with a current source 286. Current source 286 of cell 285 forms a current $I_2$. Those skilled in the art will appreciate that common cell 285 is shown separate from cells 206 and 240 for clarity of the description; however, cell 285 may be formed as an internal portion of either one of cells 206 or 240.

As will be seen further hereinafter, controller 200 is configured with a plurality of current control cells that are configured to receive an LED voltage from an LED branch of a plurality of LED branches with each current control cell having a conduction transistor configured to conduct the LED current and with the current control cell configured to create a maximum possible LED current. The plurality of current control cells is configured to select as a control cell one of the current control cells having a lowest value of the maximum possible LED current, thus, the highest voltage drop across the LEDs of that branch. The plurality of current control cells is also configured so that the selected control cell forms a control current that is representative of the lowest value of the maximum possible LED current, and to form the LED current of another LED branch of the plurality of LED branches to be ratioed to, including substantially equal to, the lowest value of the maximum possible LED current.

Assume for the purpose of explaining the operation, that the voltage drop across branch 37, for example across LED 15, is larger than the voltage drop across branch 36, for example across LED 14. Cells 206 and 240 receive the voltage from the respective branches 36 and 37 at respective inputs 201 and 202. Since the voltage received on input 202 is lower than the voltage on input 201, the voltage on the drain of transistor 242 is lower than the voltage on the drain of transistor 208, so that transistor 242 is turned-on to a greater degree than transistor 208. For cell 240, amplifier 254 and transistor 255 force a drain of transistor 256 to have the same voltage as a drain of transistor 242. A reference voltage (Ref2) is applied to the gate of transistor 256 which forces a reference current 257 to flow through transistor 256. The value of Ref2 usually is selected to be close to or equal to the voltage received on input 45 in order to ensure that transistor 256 may be turned-on fully. The voltage received on input 45 typically is the maximum operational value of the gate-to-source voltage (Vgs) for transistor 242. The maximum Vgs is no greater than the maximum Vgs that can be applied without decreasing the lifetime of the transistor or causing damage to the transistor. Typically, the value of the Ref2 voltage is approximately 0.05 to 0.1 volts less than the voltage on input 45. In one example embodiment, a transistor was designed to operate with a power supply voltage having a target value of approximately three and three tenths volts (3.3 V) and the maximum Vgs was approximately three and six-tenths volts (3.6V). For this example, the power supply voltage could be as low as three volts (3.0V).

Because the drain voltage of transistor 256 is at the same voltage as transistor 242 and the gate voltage of transistor 256 is at or near the voltage on input 45, current 257 represents the maximum possible current that can be conducted by transistor 242 at that particular drain voltage received from branch 37 on input 202. The value of current 257 generally is ratioed to or proportional to the value of current 47 because current 47 generally is a large value and it is desirable to have current 257 smaller than current 47. In other embodiments, the value of current 257 may be more equal to or substantially equal to the value of current 47.

In order to facilitate the understanding of the functionality, it will be first assumed that only cell 240 is connected to cell 285. In other words, gate of transistor 228 is not connected to transistor 290. The current mirror configuration of transistors 276 and 275 force transistor 275 to conduct a current $I_M$ that is representative of current 257 through the size ratio of transistors 275 and 276. Therefore, a current $I_T$ through transistor 271 is the value of a current $I_1$ from a current source 279 minus the value of a current $I_M$ through transistor 275 ($I_T=I_1-I_M$). The current mirror configuration of transistors 271 and 270 force a current $I_R$ through transistor 270 to be representative of the value of current $I_T$ based on the size ratio between transistors 270 and 271. Current $I_R$ also has to flow through transistor 290. The current mirror configuration of transistor 290 and 289 forms a ratio current $I_{RR}$ through transistor 289. Because of current source 286, a current $I_S$ through transistor 288 is a current $I_2$ through current source 286 minus current $I_{RR}$ ($I_S=I_2-I_{RR}$). If the current $I_2$ through source 286 is equal to current $I_1$ through source 279 (multiplied by the ratios through the chain) then the value of current $I_S$ through transistor 288 is proportional to current 257 based on the ratios of the current mirrors in the chain. The current mirror configuration of transistors 288 and 269 force the value of current 268 through transistor 269 to be representative of current through transistor 288 thus, representative of the value of current 257. Because the gate voltage of transistors 246 and 242 are the same and because the drain voltage of transistors 242 and 246 are the same, the value of current 47 is proportional to or ratioed to the value of current 268. Because transistors 242 and 256 have the same drain voltage and the gate voltage of transistor 256 is at Ref2, the gate voltage of transistor 242 will be regulated by amplifier 243 and transistors 244 and 216 to be substantially the same voltage as gate of transistor 256. Therefore, transistor 242 is fully turned-ON (fully enabled) which reduces the ON-resistance and voltage drop across transistor 242 thereby reducing the power dissipated by controller 200.

Now assume that both cells 206 and 240 are connected to cell 285. In other words, gate of transistor 228 is connected to transistors 272 and 290. Referring to cell 206, the drain of transistor 208 is at a higher voltage than the drain of transistor 242. The higher drain voltage of transistor 208 is also formed on the drain of transistor 222 by amplifier 220 and transistor 221. As result, the value of a reference current 223 is formed by cell 206 to be greater than the value of current 257. The value of current 223 is the representative of (by the ratios in the chain) the maximum possible value that transistor 208 could support flowing through transistor 208 under the conditions of the gate voltage approximately equal to the value of Ref2 and at the value of the drain voltage applied from branch 36 on input 201. As a result, transistor 228 has to conduct a lower current than transistor 272 because current 223 is subtracted from the current from current source 235 and the difference flows through transistor 228. The value of current from source 235 usually is substantially equal to the current from source 279. The lower current causes the drain voltage of transistor 228, thus the source voltage of transistor 227 to rise to a higher voltage. The higher voltage on the source of transistor 227 causes transistor 226 to switch OFF and cease conducting. Consequently, the value of current 223 has no effect on the value of current $I_S$ flowing through transistor 288. It can be appreciated that transistor 226 acts as a switch that is selectively controlled to be disabled by the value of current 223 being greater than the value of current 257. Alternately, transistor 226 is switched to be enabled if current 223 is less than current 257. Because transistor 225 is also connected in a current mirror configuration with transistor 288 (similar to transistor 269) transistor 288 forces the value of current 224 to be ratioed to, and is some embodiments substantially equal to, the value of current 268. Consequently, it can be seen that the value of current 257 is selected, as the control current and cell 240 is selected as the control cell. Because the drain of transistor 208 is at a higher voltage than the drain of transistor 242, transistor 208, thus transistor 212, are not fully switched ON and have a higher on-resistance. Therefore, current 224 flowing through transistor 212 forces the value of current 46 through transistor 208 to be ratioed to the value of control current 257, thus, ratioed to (or in some embodiments substantially equal to) the value of current 47. The ratio is set by the size ratio values of the transistors in the current mirror chain. Those skilled in the art will appreciate from the above that disabling the switch of transistor 226 causes cell 206 to form current 46 to be ratioed to (or in some embodiments substantially equal to) the value of current 47. Additionally, it can be seen that cell 206 is configured to use the second reference current, such as current 223, to cause a gate voltage of the switch of transistor 226 to increase to a value that disables the transistor 226.

Those skilled in the art will understand that if the value of the voltage dropped across branch 36 becomes larger than the voltage dropped across branch 37, controller 200 is configured to re-determine the branch having the largest voltage drop and to select the value of current 223 as the control current. Those skilled in the art will understand that logic 125 is not a portion of controller 200.

In order to facilitate the hereinbefore explained functionality for controller 200, input 201 is configured to receive LED current 46 and the voltage drop across branch 36. Input 201 is commonly connected to a drain of transistor 208 and the non-inverting input of amplifiers 209, 215, and 220. A source of transistor 208 is commonly connected to return 34, a source of transistor 212, a first terminal of capacitor 214, a source of transistor 217, and a source of transistor 222. A gate of transistor 208 is commonly connected to a drain of transistor 210, a first terminal of capacitor 214, a drain of transistor 225, and a gate of transistors 212 and 217. A drain of transistor 212 is commonly connected to a node 211, the source of transistor 210, and an inverting input of amplifier 209. An output of amplifier 209 is connected to a gate of transistor 210. An output of amplifier 215 is connected to a gate of transistor 216. A source of transistor 216 is commonly connected to a drain of transistor 217 and to an inverting input of amplifier 215. A drain of transistor 216 is connected to output 219 and to a first input of circuit 31. An output of amplifier 220 is connected to a gate of transistor 221. A source of transistor 221 is commonly connected to a drain of transistor 222 and to an inverting input of amplifier 220. A gate of transistor 222 is connected to Ref2. A drain of transistor 221 is commonly connected to a drain of transistor 232 and the gate of transistors 232 and 231. A source of transistor 232 is commonly connected to input 45 and to a source of transistors 231, 225, and 228. A drain of transistor 231 is commonly connected to a first terminal of source 235, a drain of transistor 227, and the gate of transistors 227 and 226. A source of transistor 227 is connected to a drain of transistor 228. A second terminal of source 235 is commonly connected to a drain of transistor 226 and to return 34. A source of transistor 226 is commonly connected to a gate of transistor 228 a drain of transistor 290, and the gates of transistors 290 and 289.

A source of transistor 290 is commonly connected to input 45 and a source of transistors 289 and 288. A drain of transistor 289 is commonly connected to a first terminal of source 286, a drain of transistor 288, and the gates of transistors 288 and 225. A second terminal of source 286 is connected to return 34.

Input 202 is configured to receive LED current 47 and the voltage drop across branch 37. Input 202 is commonly connected to a drain of transistor 242 and the non-inverting inputs of amplifiers 213, 249, and 254. A source of transistor 242 is commonly connected to return 34, a first terminal of capacitor 248 and a source of transistors 246, 251, and 256. A gate of transistor 242 is commonly connected to a drain of transistor 244, a second terminal of capacitor 248, a drain of transistor 269, and a gate of transistors 246 and 251. An output of amplifier 243 is connected to a gate of transistor 244. A source of transistor 244 is commonly connected to a drain of transistor 246, node 245, and an inverting input of amplifier 243. A gate of transistor 269 is connected to the gate of transistor 288. An output of amplifier 249 is connected to a gate of transistor 250. A source of transistor 250 is commonly connected to a drain of transistor 251 and to an inverting input of amplifier 249. A drain of transistor 250 is connected to output 253 and to a second input of circuit 31. An output of amplifier 254 is connected to a gate of transistor 255. A source of transistor 255 is connected to a drain of transistor 256 and to an inverting input of amplifier 254. A gate of transistor 256 is connected to Ref2. A drain of transistor 255 is commonly connected to a drain of transistor 276, and a gate of transistors 276 and 275. A source of transistor 276 is commonly connected to input 45 and a source of transistors 275, 272, and 269. A drain of transistor 275 is commonly connected to a first terminal of source 279, a drain of transistor 271, and the gates of transistors 270 and 271. A source of transistor 271 is connected to a drain of transistor 272. A gate of transistor 272 is commonly connected to a drain of transistor 290 and a source of transistor 270. A drain of transistor 270 is commonly connected to a second terminal of source 279 and to return 34.

Figure 5:
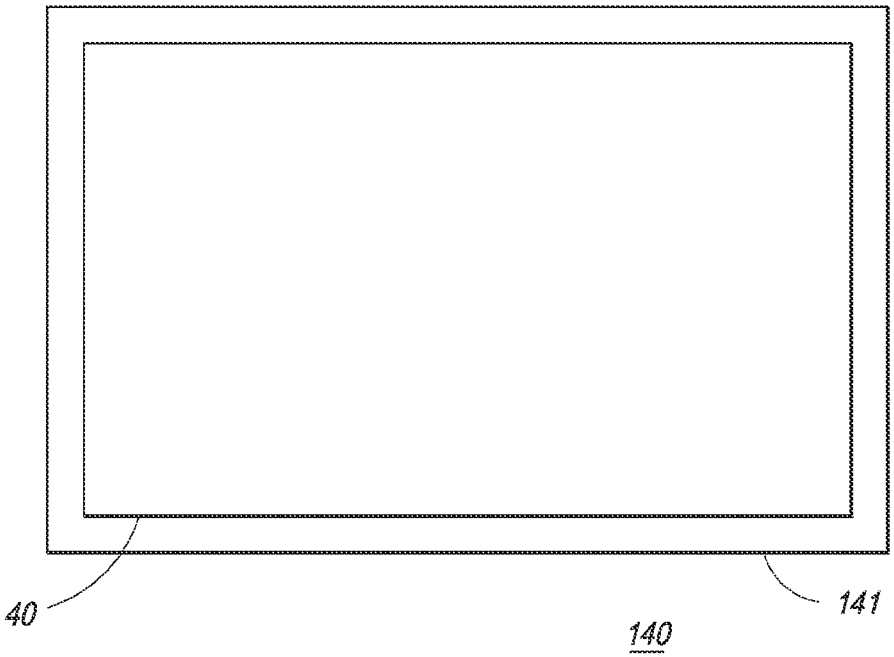
FIG. 5 illustrates an enlarged plan view of a semiconductor device that includes the LED current controller of either of FIGS. 1-3 in accordance with the present invention.

FIG. 5 illustrates an enlarged plan view of a portion of an embodiment of a semiconductor device or integrated circuit 140 that is formed on a semiconductor die 141. Controller 40 is formed on die 141. Die 141 may also include other circuits that are not shown in FIG. 5 for simplicity of the drawing. Controller 40 and device or integrated circuit 140 are formed on die 141 by semiconductor manufacturing techniques that are well known to those skilled in the art. Either of controllers 21 or 200 may be formed on die 141 instead of or in addition to controller 40.

From all the foregoing, one skilled in the art will appreciate that in one embodiment, a method of forming an LED current controller comprises:

forming a first current control cell, such as one of cells 50, 75, 100, 206, and 240, to receive a first LED current from a first LED branch, the first LED branch having a first voltage drop across the first LED branch;

forming a second current control cell for example another of cells 50, 75, 100, 206, and 240, to receive a second LED current from a second LED branch having a common connection in a pseudo-parallel configuration with the first LED branch, the second LED branch having a second voltage drop across the second. LED branch;

forming the LED current controller to determine a larger one of the first or second voltage drops and responsively select one of the first or second LED currents (such as current 47 for example) respectively, and to form a control current, such as current 96 or 257, that is ratioed to the one of the respective first or second LED currents; and forming the first and second current control cells to regulate another of the first and second LED currents to be ratioed to the control current.

In another embodiment, the method may include forming the first and second current control cells to select the first current control cell as a control cell and to form a control current that is ratioed to the first LED current responsively to the first voltage drop being larger than the second voltage drop or to select the second current control cell as the control cell and to form the control current that is ratioed to the second LED current responsively to the second voltage drop being larger than the first voltage drop.

Another embodiment of the method may include forming the LED current controller to periodically re-determine the larger one of the first or second voltage drops and responsively re-select one of the respective first or second LED currents.

In yet another embodiment, the method may include forming the first and second current control cells to compare a first voltage, for example the voltage on the drain of transistor 93, that is representative of the first voltage drop and a second voltage, for example the voltage on the drain of transistor 68, that is representative of the second voltage drop to a reference to determine if the first voltage drop is larger than the second voltage drop.

Another embodiment of the method may include that the step of forming the first and second current control cells to determine the larger one includes forming the first and second current control cells to form a maximum current, such as currents 223 and/or 257 for example, that is representative of a maximum possible current value for each of the first and second current control cells, to select a smallest of the maximum current values (such as current 257 for example), and to form another of the first or second LED currents, such as current 46, to be ratioed to a value of the smallest of the maximum current values.

Another embodiment of the method may also include forming the LED current controller to form a first maximum current value for the first current control cell as a function, for example related by the on-resistance characteristics of transistors 222 or 256, of the first voltage drop across the first LED branch and to form a second maximum current value for the second current control cell as a function, for example related by the on-resistance characteristics of a different one of transistors 222 or 256, of the second voltage drop across the second LED branch, and to select, a smaller of the first or second maximum current values for the control current.

Those skilled in the art will appreciate that another method of forming an LED current controller may comprise:

forming a first current control cell, for example cell 240, to receive a first LED current, and a first LED voltage from a first LED branch, the first LED current having a first value and the first LED voltage having a first received value;

forming the first current control cell to form a first reference current, current 257 for example, that is representative of a maximum possible current for the first current control cell at the first received value of the first LED voltage;

forming a second current control cell, for example cell 206, to receive a second LED current and a second LED voltage from a second LED branch that is coupled in pseudo-parallel with the first LED branch, the second LED current having a second value and the second LED voltage having a second received value;

forming the second current control cell to form a second reference current, current 223 for example, that is representative of a maximum possible current for the second control cell at the second received value of the second LED voltage; and forming a common cell to determine a smaller of the first or second reference currents, for example current 257, and to form another of the first or second LED currents, current 46 for example, to be ratioed to the smaller of the first or second reference currents.

In another embodiment the method may also include coupling a control transistor, transistor 208 for example, of the first current control cell to receive the first LED current, and configuring a first transistor, for example transistor 222, to operate with a drain voltage that is substantially equal to a drain voltage of the control transistor wherein the first transistor forms the reference current to flow through the first transistor.

Another example of the method may include configuring the second current control cell, such as cell 206 for example, to disable a switch transistor, for example transistor 226, responsively to the second reference current having a value that is greater than a value of the first reference current.

Other embodiments of the method may include configuring the second current control cell to use the second reference current to cause a source voltage of the switch transistor, such as the being be same voltage as the drain of transistor 228 to increase to a value that disables the switch transistor.

Those skilled in the art will also appreciate that an LED current controller may comprise:

a plurality of LED current inputs configured to each receive an LED current from a plurality of LED branches, one LED current for each LED branch;

a plurality of current control cells having a conduction transistor, such as one of transistors 52, 77, 102, 208, or 242, configured to conduct the LED current wherein the plurality of current control cells includes one current control cell for each LED current;

the plurality of current control cells configured to select as a control cell one of the plurality of current control cells that is coupled to an LED branch of the plurality of LED branches that has a highest voltage drop and configured to form a control current, such as current 96 or 257, that is representative of the LED current through the control cell wherein the plurality of current control cells are configured to fully enable the conduction transistor of the control cell; and the plurality of current control cells configured to form the LED current of other LED branches of the plurality of LED branches to be ratioed to the control current.

In another embodiment, the LED current controller may be configured to compare a voltage, such as the drain voltage of transistor 93, that is representative of a voltage drop across an LED branch of the plurality of LED branches to a reference to determine the current control cell that receives the highest voltage drop and responsively select the control cell.

Another embodiment of the LED current controller may include a common cell, such as cell 125 for example, coupled to receive a result, for example the outputs of comparators 65, 90, and 115, of comparing the voltage to the reference and form a control signal, such as one of control signals 126-128, that forms a current mirror that mirrors the control current to other current control cells of the plurality of current control cells.

Another embodiment of the LED current controller may include that each current control cell is configured to form a drain voltage of a mirror transistor, for example transistor 93, and compare the drain voltage of the mirror transistor to a reference voltage to determine the LED branch of the plurality of LED branches that has the highest voltage drop.

Another embodiment of the LED current controller includes a current mirror having the mirror transistor, such as transistor 93 for example, and a switch transistor, such as transistor 91 for example, wherein each current control cell is configured to enable the switch transistor to couple the mirror transistor as a reference transistor of the current mirror responsively to the voltage from the drain of the mirror transistor.

Those skilled in the art will appreciate that one embodiment of a method of forming an LED current controller comprises, configuring a plurality of current control cells, such as cells 75 and 50 or 206 and 240 for example, to each receive an LED current from an LED branch wherein the plurality of current control cells include one current control cell for each LED current, for example cell 240 for current 47 or cell 75 for current 47; configuring a conduction transistor, such as transistor 77 of cell 75 or transistor 242 of cell 240 for example, of each current control cell to conduct an LED current;

configuring the LED current controller to selectively choose one current control cell as a control cell and to select the conduction transistor of the control cell as a control, transistor, for example cell 75 and transistor 77 or cell 240 and transistor 242;

configuring the LED controller to enable the control transistor to operate in a fully-ON mode; and configuring LED controller to form the LED current through other current control cells, such as other cell 206 and current 46 or at least one of other cells 50 or 100 and respective current 46 or 48 for example, of the plurality of current control cells to be ratioed to the control current.

In an alternate embodiment, the method may include configuring the LED current controller to selectively choose the control cell responsively to a value of voltage received by the control cell from a corresponding LED branch of the plurality of LED branches, such as the voltage received by transistor 77 from branch 37 or the voltage received by transistor 242 from branch 37.

Another alternate embodiment of the method may include configuring the LED current controller to selectively choose the control cell responsively to a lowest value of voltage received from the plurality of LED branches.

A further alternate embodiment of the method may include configuring the LED controller to form a gate-to-source voltage of the control transistor substantially equal to one of a maximum value or no less than 50 mV less than a supply voltage supplied to the LED current controller. In view of all of the above, it is evident that a novel device and method is disclosed. Included, among other features, is forming a current controller to determine which light source, such as an LED light source, drops the largest voltage across the light source, that is which input voltage received from the light source has the lowest value relative to a common reference voltage such as a ground reference, and to responsively select the current from that light source to use to control the value of current that flows through other light sources. One advantage of the novel, device is to fully enable the control transistor which receives lowest, value voltage. Fully enabling the control, transistor reduces the amount of power dissipated by the current controller and the associated system.

The skilled artisan will also appreciate that an embodiment of an LED current controller may comprise:

a plurality of current control cells, such as cells 50, 75, and 100 for example, with each current control cell of the plurality of current control cells configured to receive an LED current, such as respective currents 46, 47, and 48 for example, from an LED wherein each current control cell includes a conduction transistor, for example respective transistors 52, 77, and 102, a means to select one conduction transistor as a control transistor, for example common cell 125 and transistors 91 and 93 or common cell 285, and a means, for example the current mirrors of transistors 68, 93, and 118, to form a current through other conduction transistor to be ratioed to current conducted by the control transistor.

While the subject matter of the descriptions are described with specific preferred embodiments and example embodiments, the foregoing drawings and descriptions thereof depict only typical and example embodiments of the subject matter and are not therefore to be considered to be limiting of its scope, it is evident that many alternatives and variations will be apparent to those skilled in the art. For example, although controllers 21, 40, and 200 are explained controlling the current through an LED light source, those skilled in the art will appreciate that controllers 21, 40, and 200 may be used for controlling and/or distributing current though multiple loads of other types including current through other light sources, such as incandescent light bulbs, etc. As will be appreciated by those skilled in the art, the example form of system 10 and controllers 21, 40, and 200 are used as a vehicle to explain the operation method of detecting the branch having the largest voltage drop and using the current of the branch to control the value of the current flowing through other branches, and that other circuit configurations may also be used.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of an invention. Furthermore, while some embodiments described herein include some but not other features included in other embodiments, combinations of features of different embodiments are meant to be within the scope of the invention, and form different embodiments, as would be understood by those skilled in the art.

The invention claimed is:

1. A method of forming an LED current controller comprising:

forming a first current control cell to receive a first LED current from a first LED branch, the first LED branch having a first voltage drop across the first LED branch;

forming a second current control cell to receive a second LED current from a second LED branch having a common connection in a pseudo-parallel configuration with the first LED branch, the second LED branch having a second voltage drop across the second LED branch;

forming the LED current controller to determine a larger one of the first or second voltage drops and responsively select one of the first or second LED currents, respectively, and to form a control current that is ratioed to the one of the respective first or second LED currents; and forming the first and second current control cells to regulate another of the first and second LED currents to be ratioed to the control current.

2. The method of claim 1 wherein forming the LED current controller to determine the larger one of the first or second voltage drops includes forming the first and second current control cells to select the first current control cell as a control cell and to form a control current that is ratioed to the first LED current responsively to the first voltage drop being larger than the second voltage drop or to select the second current control cell as the control cell and to form the control current that is ratioed to the second LED current responsively to the second voltage drop being larger than the first voltage drop.

3. The method of claim 1 including forming the LED current controller to periodically re-determine the larger one of the first or second voltage drops and responsively re-select one of the respective first or second LED currents.

4. The method of claim 1 including forming the first and second current control cells to regulate another of the first and second LED currents to be substantially equal to the selected one of the respective first or second LED currents.

5. The method of claim 1 wherein the step of forming the first and second current control cells to determine the larger one includes forming the first and second current control cells to compare the first voltage drop and the second voltage drop to a reference to determine if the first voltage drop is larger than the second voltage drop.

6. The method of claim 1 wherein the step of forming the first and second current control cells to determine the larger one includes forming the first and second current control cells to form a maximum current that is representative of a maximum possible current value for each of the first and second current control cells, to select a smallest of the maximum current values, and to form another of the first or second LED currents to be ratioed to a value of the smallest of the maximum current values.

7. The method of claim 6 further including forming the LED current controller to form a first maximum current value for the first current control cell as a function of the first voltage drop across the first LED branch and to form a second maximum current value for the second current control cell as a function of the second voltage drop across the second LED branch, and to select a smaller of the first or second maximum current values for the control current.

8. A method of forming an LED current controller comprising:

forming a first current control cell, to receive a first LED current and a first LED voltage from a first LED branch, the first LED current having a first value and the first LED voltage having a first received value;

forming the first current control cell to form a first reference current that is representative of a maximum possible current for the first current control cell at the first received value of the first LED voltage;

forming a second current control cell to receive a second LED current and a second LED voltage from a second LED branch that is coupled in pseudo-parallel with the first LED branch, the second LED current having a second value and the second LED voltage having a second received value;

forming the second current control cell to form a second reference current at a second value that is representative of a maximum possible current for the second control cell at the second received value of the second LED voltage; and forming a common cell to determine a smaller of the first or second reference currents and to form another of the first or second LED currents to be ratioed to the smaller of the first or second reference currents.

9. The method of claim 8 wherein forming the first current control cell to form the first reference current includes coupling a control transistor of the first current control cell to receive the first LED current, and configuring a first transistor to operate with a gate voltage that is substantially equal to a maximum gate voltage of the first transistor and form the second value of the second reference current.

10. The method of claim 8 wherein forming the common cell to determine the smaller of the first or second reference currents includes configuring the second current control cell to disable a switch transistor responsively to the second reference current having a value that is greater than a value of the first reference current.

11. The method of claim 10 wherein configuring the second current control cell to disable a switch transistor includes configuring the second current control cell to use the second reference current to cause a gate voltage of the switch transistor to increase to a value that disables the switch transistor.

12. An LED current controller comprising:

a plurality of LED current inputs configured to each receive an LED current from a plurality of LED branches, one LED current for each LED branch;

a plurality of current control cells having a conduction transistor configured to conduct the LED current wherein the plurality of current control cells includes one current control cell for each LED current;

the plurality of current control cells configured to select as a control cell one of the plurality of current control cells that is coupled to an LED branch of the plurality of LED branches that has a highest voltage drop and configured to form a control current that is representative of the LED current through the control cell wherein the plurality of current control cells are configured to fully enable the conduction transistor of the control cell; and the plurality of current control cells configured to form the LED current of other LED branches of the plurality of LED branches to be ratioed to the control current.

13. The LED current controller of claim 12 wherein each current control cell is configured to compare a voltage that is representative of a voltage drop across an LED branch of the plurality of LED branches to a reference to determine the current control cell that receives the highest voltage drop and responsively select the control cell.

14. The LED current controller of claim 13 further including a common cell coupled to receive a result of comparing the voltage to the reference and form a control signal that forms a current mirror that mirrors the control current to other current control cells of the plurality of current control cells.

15. The LED current controller of claim 12 wherein each current control cell is configured to form a drain voltage of a mirror transistor and compare the drain voltage of the mirror transistor to a reference voltage to determine the LED branch of the plurality of LED branches that has the highest voltage drop.

16. The LED current controller of claim 12 wherein each current control cell includes a current mirror having the mirror transistor and a switch transistor wherein each current control cell is configured to enable the switch transistor to couple the mirror transistor as a reference transistor of the current mirror responsively to a gate voltage of the control transistor.

17. A method of forming an LED current controller comprising:

configuring a plurality of current control cells to each receive an LED current from an LED branch, one LED current for each LED branch wherein the plurality of current control cells includes one current control cell for each LED current;

configuring a conduction transistor of each current control cell to conduct an LED current;

configuring the LED current controller to selectively choose one current control cell as a control cell and to select the conduction transistor of the control cell as a control transistor;

configuring the LED controller to enable the control transistor to operate in a fully-ON mode; and configuring LED controller to form the LED current through other current control cells of the plurality of current control cells to be ratioed to the control current.

18. The method of claim 17 wherein configuring the LED current controller to selectively choose one current control cell as the control cell includes configuring the LED current controller to selectively choose the control cell responsively to a value of voltage received by the control cell from a corresponding LED branch of the plurality of LED branches.

19. The method of claim 18 wherein configuring the LED current controller to selectively choose the control cell responsively to the value of voltage received by the current control cell from the corresponding LED branch includes configuring the LED current controller to selectively choose the control cell responsively to a lowest value of voltage received from the plurality of LED branches.

20. The method of claim 17 wherein configuring the LED controller to enable the control transistor to operate in the fully-ON mode includes configuring the LED controller to form a gate-to-source voltage of the control transistor substantially equal to one of a maximum value or no less than 50 mV less than a supply voltage supplied to the LED current controller.

* * * * *